United States Patent [19]

Yoshizawa et al.

[11] Patent Number: 4,678,731

[45] Date of Patent: Jul. 7, 1987

[54] ELECTROPHOTOGRAPHIC PHOTOSENSITIVE MEMBER HAVING BARRIER LAYER COMPRISING MICROCRYSTALLINE SILICON CONTAINING HYDROGEN

[75] Inventors: Shuji Yoshizawa, Tokyo; Wataru Mitani; Mariko Yamamoto, both of Yokohama; Akira Sanjoh, Aichi; Tatsuya Ikezue, Tokyo, all of Japan

[73] Assignee: Kabushiki Kaisha Toshiba, Kawasaki, Japan

[21] Appl. No.: 877,519

[22] Filed: Jun. 23, 1986

[30] Foreign Application Priority Data

Jun. 25, 1985 [JP] Japan ..... 60-138207
Jun. 25, 1985 [JP] Japan ..... 60-138208
Jun. 25, 1985 [JP] Japan ..... 60-138209
Jun. 25, 1985 [JP] Japan ..... 60-138214

[51] Int. Cl.[4] ..... G03G 5/14
[52] U.S. Cl. ..... 430/65; 430/945
[58] Field of Search ..... 430/65, 945

[56] References Cited

U.S. PATENT DOCUMENTS 4,490,453 12/1985 Shirai et al. ..... 430/65
4,560,634 12/1985 Matsuo et al. ..... 430/128 X

OTHER PUBLICATIONS

Solar Energy Materials 11 (1984), pp. 85–95.

*Primary Examiner*—J. David Welsh
*Attorney, Agent, or Firm*—Schwartz, Jeffery, Schwaab, Mack, Blumenthal & Evans

[57] ABSTRACT

In an electrophotographic photosensitive member according to the present invention, a barrier layer is formed on a conductive substrate, and a photoconductive layer on the barrier layer. Formed of microcrystalline silicon, the photoconductive layer is highly sensitive to long-wavelength light. The barrier layer is formed of microcrystalline silicon containing an element included in group III or V of the periodic table. The rectifying action of the barrier layer prevents carriers from being injected into the photoconductive layer from the substrate side. Containing carbon, oxygen, or nitrogen, the barrier layer has high dark resistance and chargeability.

18 Claims, 13 Drawing Figures

ELECTROPHOTOGRAPHIC PHOTOSENSITIVE MEMBER HAVING BARRIER LAYER COMPRISING MICROCRYSTALLINE SILICON CONTAINING HYDROGEN

BACKGROUND OF THE INVENTION

The present invention relates to an electrophotographic photosensitive member, with improved chargeability, photosensitivity, and environmental durability.

Organic and inorganic materials have conventionally been used to form photoconductive layers of electrophotographic photosensitive members. Among the inorganic materials are CdS, ZnO, selenium, Se-Te system, and amorphous silicon. The organic materials include polyNvinyl carbazole (PVCz) and trinitrofluorenone (TNF). In the photosensitive members using these photoconductive materials, however, there are various problems related to their photoconductive characteristics and workmanship. Therefore, the characteristics of the photosensitive system have been sacrificed in some measure in using these materials properly according to the applications.

For example, selenium and CdS are harmful to health, and must be prepared with special care for safety's sake. Accordingly, they require complicated manufacturing apparatuses and thereby entail high production costs. In particular, selenium must be recovered and this necessitates additional cost. Moreover, selenium and Se-Te system, whose crystallization temperature is as low as 65° C., will be confronted with problems related to their photoconductive characteristics, such as residual potential, during repeated copying operations. Therefore, they are shortlived and not very practical.

Further, ZnO is not reliable in use because it is liable to oxidize or reduce, and is highly susceptible to the environmental atmosphere.

It is suspected, furthermore, that organic photoconductive materials such as PVCz and TNF are carcinogens. Besides being harmful to health, they are low in thermal stability and in wear resistance, and are therefore shortlived.

Meanwhile, amorphous silicon (hereinafter abbreviated to a-Si) is a photoconductive material which has recently become the object of public attention. It is frequently applied to solar cells, thin-film transistors, and image sensors. As a part of such applications, a-Si has been tried as a material for electrophotographic photosensitive members. Since a-Si produces no pollutant, photosensitive members formed of a-Si need not be recovered. Also, they have higher spectral sensitivity in the visible radiation area than those made of other materials, and are high in surface hardness, wear resistance, and shock resistance.

Amorphous silicon is being studied as a material in photosensitive members for electrophotography, based on the Carlson process. In this connection, the members must have high resistance and photosensitivity. It is difficult, however, for a single-layer photosensitive member to provide both these characteristics. To meet these requirements, therefore, laminate-type photosensitive members have been developed which are constructed such that a barrier layer is sandwiched between a photoconductive layer and a conductive substrate, and a surface charge retentive layer is formed on the photoconductive layer.

Usually, a-Si is formed by the glow discharge decomposition process, using silane gas. In this process, hydrogen is trapped in an a-Si film, so that the electrical and optical characteristics of the film vary considerably, depending on the hydrogen content. If the amount of hydrogen incorporated in the a-Si film increases, the optical band gap becomes greater, increasing the resistance of the film, so that the film has reduced sensitivity to long wavelength light. It is therefore difficult to use it suitably, for example, in a laser beam printer mounted with a semiconductor laser. If the hydrogen content of the a-Si film is high, $(SiH_2)_n$ and other bonds may sometimes occupy the greater part of the film, depending on the filming conditions. Thereupon, voids spread, thus increasing silicon dangling bonds, lowering the photoconductive characteristics. Thus, the film cannot be used for an electrophotographic photosensitive member. If the amount of hydrogen incorporated in the a-Si film is reduced, on the other hand, the optical band gap is narrowed, thus reducing the resistance of the film, although the film now has increased sensitivity to longer-wave light. If the hydrogen content is low, however, less hydrogen links with the silicon dangling bonds, thereby reducing them. Accordingly, the mobility of resulting carriers is reduced, and the film is lowered in life performance and photoconductive characteristics. Thus, the film becomes unfit for use in the photosensitive member.

In a conventional method of increasing the sensitivity to longer-wave radiation, silane gas is mixed with germane ($GeH_4$), and is subjected to glow discharge decomposition, thereby forming a film with a narrow optical band gap. In general, silane gas and $GeH_4$ are different in the optimum substrate temperature, so that the resultant film is subject to many structural defects and cannot provide satisfactory photoconductive characteristics. Moreover, waste gas from $GeH_4$ becomes poisonous when it is oxidized, thus requiring a complicated processing system. In consequence, this technique is not practical.

SUMMARY OF THE INVENTION

The object of the present invention is to provide an electrophotographic photosensitive member which enjoys improved chargeability, low residual potential, high sensitivity over a wide wavelength range, good adhesion to substrate, and improved environmental capability.

According to the present invention, there is provided an electrophotographic photosensitive member which comprises a conductive substrate, a barrier layer provided on the conductive substrate, at least part of the barrier layer being formed of microcrystalline silicon containing hydrogen, an element included in group III or V of the periodic table, and at least one element selected from carbon, oxygen, and nitrogen, and a photosensitive layer provided on the barrier layer, at least part of the photosensitive layer being formed of microcrystalline silicon.

The present invention is based on the results of various experiments conducted by the inventors hereof. The electrophotographic photosensitive member of the invention at least partially includes microcrystalline silicon (hereinafter abbreviated to μc-Si) as a photosensitive material, thereby eliminating the aforementioned drawbacks of the prior art and providing good photoconductive or electrophotographic characteristics and high environmental capability.

The present invention is characterized in that μc-Si is used in place of a-Si for the prior art material. The whole region or part of the photosensitive member is formed of μc-Si, or a mixture of μc-Si and a-Si, or a laminate structure of μc-Si and a-Si. In a separate-function photosensitive member, μc-Si is used for a charge generating layer.

Microcrystalline silicon is clearly distinguished from a-Si and polycrystalline silicon by the following physical properties. In an X-ray diffraction measurement, a-Si develops only halos and produces no diffraction pattern, due to its amorphousness, while μc-Si produces a crystal diffraction pattern with $2\theta$ ranging from 27 to 28.5 degrees. While the dark resistance of polycrystalline silicon is $10^6$ Ω·cm, that of μc-Si is $10^{11}$ Ω·cm or more. Microcrystalline silicon is an aggregate consisting of microcrystalline with a grain diameter of tens of angstroms or more.

The mixture of μc-Si and a-Si is a substance in which the crystal structure of μc-Si is present in a-Si, so that both materials are equal in volume. The laminate structure of μc-Si and a-Si is a structure which includes a layer formed mainly of a-Si and a layer stuffed with μc-Si.

The photosensitive layer and barrier layer including μc-Si, like the one including a-Si, can be formed by depositing μc-Si on a conductive substrate by the high-frequency glow discharge decomposition process, using silane gas as a material. The formation of μc-Si is facilitated if the substrate temperature and high-frequency power are set higher than in the case of the a-Si layer. If the temperature and power are higher, then the flow volume of material, such as silane gas can be increased in proportion, permitting faster filming. Further, μc-Si may be formed more efficiently by diluting $SiH_4$, $Si_2H_6$ or other silane gas of higher order, with hydrogen.

The μc-Si has an optical band gap of approximately 1.6 eV, as compared with 1.65 to 1.7 eV gap of a-Si. In general, a photoconductive layer or a charge generating layer of the photosensitive layer absorbs those components of incident light which have greater energy than the optical band gap of the photosensitive layer, and produces carriers correspondingly. Meanwhile, longer-wave light, such as near-infrared radiation, has less energy than visible radiation has. Therefore, a-Si, which has high enough sensitivity to visible light, has only a low sensitivity to near-infrared radiation or other longer-wave light. On the other hand, μc-Si, whose optical band gap is smaller than that of a-Si, has high enough sensitivity to longerwave light. Thus, it produces carriers when exposed to longer-wave light. In a laser printer mounted with a semiconductor laser, the oscillation wavelength of the laser is 790 nm, falling within the range for near-infrared radiation. If μc-Si is used in a part of the photosensitive layer, as in the present invention, the layer enjoys a high photosensitivity over a wide range covering both visible radiation and near-infrared radiation. Thus, the present invention may be applied to laser printers, as well as plain paper copiers (PPC).

According to this invention, moreover, the μc-Si constituting the barrier layer contains at least one element selected from carbon, oxygen, and nitrogen for higher chargeability.

According to the invention, furthermore, there may be provided an electrophotographic photosensitive member which enjoys high resistance, improved charging capability, and high sensitivity to both visible and near-infrared radiations, and is highly practical and easy to manufacture.

DETAILED DESCRIPTION OF THE PREFERRED EMBODIMENTS

Figure 1:
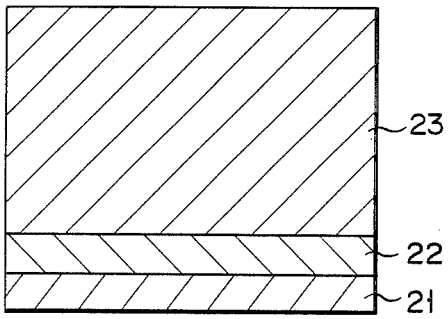
FIGS. 1 and 2 are partial sectional views showing electrophotographic photosensitive members according to an embodiment of the present invention.
Figure 2:
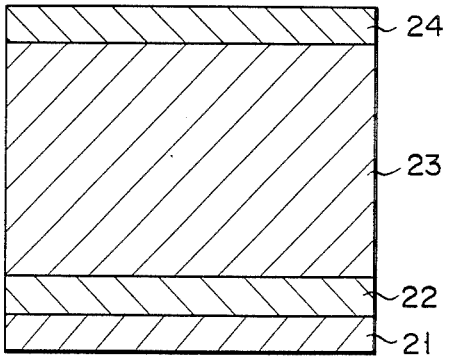

Embodiments of the present invention will now be described in detail. FIGS. 1 and 2 are partial sectional views showing an electrophotographic photosensitive member according to an embodiment of the invention. In FIG. 1, barrier layer 22 is formed on conductive substrate 21, and photoconductive layer 23 as a photosensitive layer, is formed on layer 22. In FIG. 2, surface layer 24 is formed on photoconductive layer 23.

Photoconductive layer 23, which is formed mainly of μc-Si, has extremely high photosensitivity over a wide range of wavelength covering both visible radiation and near-infrared radiation (e.g., centering around a wavelength of 790 nm; equivalent to the oscillation wavelength of semiconductor laser). Thus, the photosensensitive member can be used for both plain paper copiers (PPC) and laser printers.

The microcrystalline silicon constituting photoconductive layer 23 is more or less of an n-type. Therefore layer 23 is preferably light-doped (to $10^{-7}$ to $10^{-3}$ atomic percent) with an element included in group III of the periodic table. The doping converts layer 23 to an i-type (intrinsic) semiconductor, whose dark resistance is high and whose signal-to-noise ratio and chargeability are improved. Also, layer 23 preferably contains at least one element selected from carbon, oxygen, and nitrogen, so that the photosensitive member has improved electric charge-holding capability. The photoconductive layer has a thickness ranging from 3 to 80 μm, preferably from 10 to 50 μm.

Photoconductive layer 23 may be formed substantially wholly from μc-Si or from a mixture or laminate structure of a-Si and μc-Si. The laminate structure has higher chargeability, while the mixture has higher sensitivity to light with a long wavelength corresponding to the infrared region. These two structures are substantially equal in sensitivity to visible radiation. Thus, layer 23 may be formed in an alternative manner depending on the application of the photosensitive member.

Barrier layer 22 serves to prevent injection of electrons or holes from substrate 21 into photoconductive layer 23, when in darkness. When irradiated, layer 22 allows a charge produced in the photoconductive layer to pass to the side of substrate 21 at a high rate. Thus, the charge-retentivity of the surface of the photosensitive member and its chargeability can be improved. Barrier layer 22 is formed of μc-Si, which has a low resistance and high carrier running capability, and therefore, high charge-blocking capability. The thickness of barrier layer 22 preferably ranges from 0.01 to 10 μm, more preferably from 0.1 to 2 μm.

In positively charging the photosensitive member surface according to the Carlson process, the barrier layer is converted to a p-type semiconductor in order to prevent electrons from being injected into the photoconductive layer from the substrate side. In negatively charging the surface, on the other hand, the barrier layer is changed to an n-type semiconductor, in order to prevent holes from being injected into the photoconductive layer from the substrate side.

To convert the μc-Si layer into a p-type semiconductor, it is preferably doped with an element included in group III of the periodic table, e.g., boron, aluminum, gallium, indium, thallium, etc. To convert it into an n-type semiconductor, it is preferably doped with an element included in group V of the periodic table, e.g., nitrogen, phosphorus, arsenic, antimony, bismuth, etc. By doping with the p- or n-type impurity, the charge carriers are prevented from moving from the substrate side to the photoconductive layer. The impurity content of the layer preferably ranges from $10^{-3}$ to 10 atomic percent.

Barrier layer 22 of μc-Si is doped with at least one element selected from nitrogen, carbon, and oxygen. Thus, the layer has increased dark resistance for higher photoconductive characteristics. The doping element or elements act as a terminator for silicon dangling bonds. Thus, the state density of the dangling bonds in forbidden bands between energy bands are lowered, so that the dark resistance is increased, resulting in higher chargeability of the electrophotographic photosensitive member. The carbon, oxygen, or nitrogen content preferably ranges from 0.1 to 20 atomic percent.

The μc-Si preferably contains 0.1 to 30 atomic percent of hydrogen. Thus, the dark and light resistances are well-matched for improved photoconductive characteristics. When doping the μc-Si layer with hydrogen by, e.g., the glow discharge decomposition process, $SiH_4$, $Si_2H_6$ or other silane gas, as a material gas, and hydrogen, as a carrier gas, are introduced into a reaction container for glow discharge. Alternatively, the gas mixture for the reaction may be a combination of hydrogen gas and silicon halide, such as $SiF_4$, $SiCl_4$, etc., or of silane gas and silicon halide. Moreover, the μc-Si layer may be formed by sputtering or other physical methods, as well as by the glow discharge decomposition process. For the sake of the photoconductive characteristics, the photoconductive layer including μc-Si preferably has a thickness of 3 to 80 μm, more preferably 10 to 50 μm.

As shown in FIG. 2, surface layer 24, which is optionally provided on photoconductive layer 23 of the electrophotographic photosensitive member, is formed of a-Si containing at least one element selected from carbon, oxygen, and nitrogen. Thus, the surface of the photoconductive layer is protected and improved in environmental capability and in chargeability. The carbon, oxygen and/or nitrogen content of layer 24 preferably ranges from 10 to 50 atomic percent. Since μc-Si of photoconductive layer 23 has a relatively high refractive index of 3 or 4, its surface is liable to reflect light. If such light reflection occurs, the volume of light absorbed by layer 23 is lowered, increasing the loss of light. Preferably, therefore, surface layer 24 is used to prevent such reflection. Layer 24 also serves to protect the layer 23 against damage and improve the chargeability of the surface of the photosensitive member.

Photoconductive layer 23 and barrier layer 22 may be made to contain at least one element selected from carbon, oxygen, and nitrogen in suitable regions thereof on the surface and substrate sides. In the region of the substrate side, the density of carbon, oxygen, or nitrogen may be uniform or lowered gradually with distance from the conductive substrate. Within this region, moreover, the element may be distributed so that its density is uniform in the barrier layer and, in the photoconductive layer, it is lowered gradually with distance from the barrier layer. In the surface-side region, the element may be distributed locally at the top portion of layer 23, or for uneven density. In any case, the total element content of layers 22 and 23 on the surface and substrate sides is preferably restricted to 20 atomic percent or less.

If μc-Si is made to contain carbon, oxygen and/or nitrogen in this manner, carriers can move smoothly at high efficiency, without being arrested during irradiation. If barrier layer 22 and surface layer 24 are doped with one or more elements, the element densities of photoconductive layer 23 and layers 22 and 24 vary drastically. According to the present invention, however, carbon, oxygen and/or nitrogen is distributed in the boundary region between the layers, so that a sudden change of the element density is prevented, to provide a smooth flow of carriers in the boundary region. During repeated use, this effect holds the residual potential of the photosensitive member down to a low level, thus providing satisfactory electrophotographic characteristics. At the time of filming, moreover, the effect prevents separation of film due to stress concentration among different substances, and also prevents cracking of film, attributed to internal stress distortion.

Figure 3A:
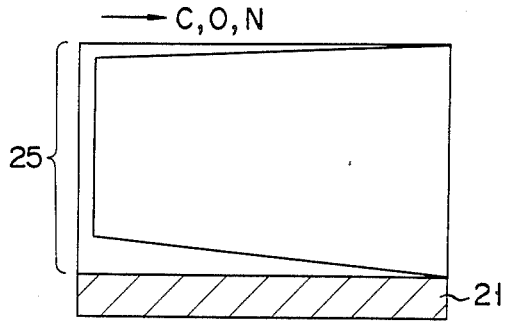
FIGS. 3A to 3H are diagrams showing density distributions of C, O, or N in μc-Si layer.
Figure 3B:
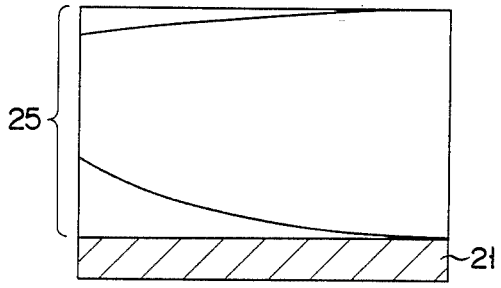
Figure 3C:
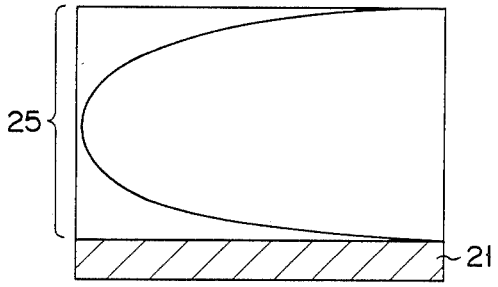
Figure 3D:
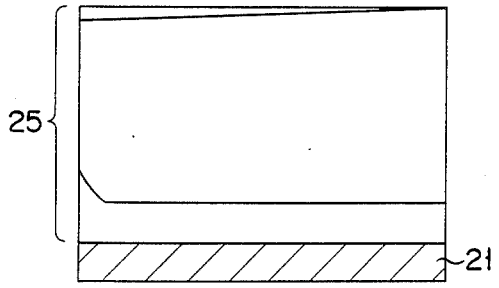
Figure 3E:
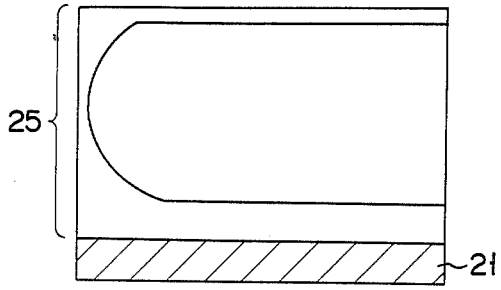
Figure 3F:
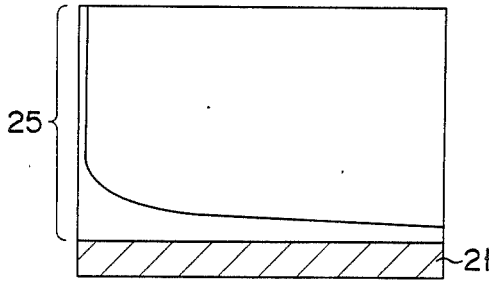
Figure 3G:
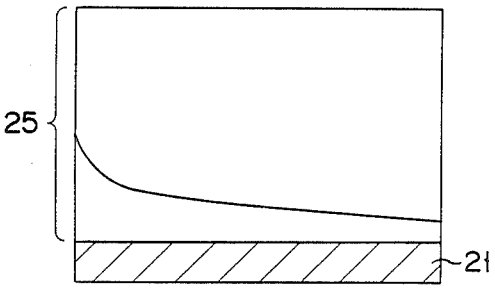
Figure 3H:
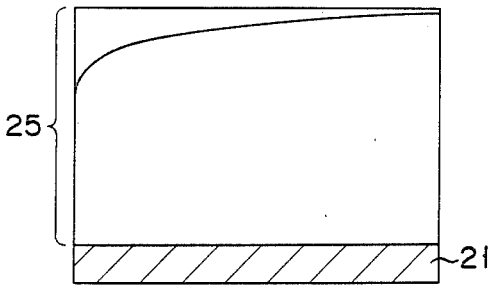

Carbon, oxygen, or nitrogen may be distributed in a manner such that its density varies with distance from the surface of the photosensitive member and/or the boundary between the barrier layer and the conductive substrate. FIGS. 3A to 3H show density distributions of carbon, oxygen and/or nitrogen in μc-Si layer 25, which includes photoconductive layer 23 and barrier layer 22. In a pattern shown in FIG. 3A, the element density in layer 25 is lowered gradually with distance from the boundary between barrier layer 22 and substrate 21, and also with distance from the surface of layer 25 or from the boundary between surface layer 24, if any, and photoconductive layer 23. For higher charge-retentivity, layer 23 contains carbon, oxygen and/or nitrogen to a degree such that the photoconductivity is not lowered. In other patterns shown in FIGS. 3B to 3H, the element density varies in the same manner as aforesaid. As shown in FIGS. 3F to 3H, a layer containing carbon, oxygen and/or nitrogen may be formed on either the surface side or the substrate side of μc-Si layer 25.

If μc-Si layer 25 is made to contain carbon, oxygen and/or nitrogen in this manner, carriers can move smoothly at high efficiency, without being arrested during irradiation. If surface layer 24 is doped with one or more elements, the element densities of photoconductive layer 23 and surface layer 24 will be different. However, if the element density is lowered gradually with distance from the boundary between layers 23 and 24, a sudden change of the element density is prevented, to provide a smooth flow of carriers in the boundary region. Moreover, if the element density in barrier layer 22 is lowered with distance from substrate 21, the density difference between layer 22 and photoconductive layer 23, which may contain none of the elements or be lightdoped with the element(s), is reduced. Also, in the boundary region between layers 23 and 22, the element density changes only gently, to provide a smooth movement of carriers. During repeated use, these effects hold the residual potential of the photosensitive member down to a low level, thus providing satisfactory electrophotographic characteristics. At the time of filming, moreover, the effects prevent separation of film due to stress concentration among different substances, and also prevent cracking of film, attributed to internal stress distortion. Preferably, the element content is restricted to 20 atomic percent or less.

Figure 4:
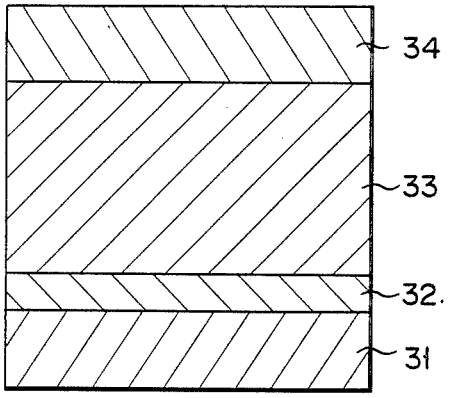
FIGS. 4 and 5 are partial sectional views showing electrophotographic photosensitive members according to another embodiment of the present invention.
Figure 5:
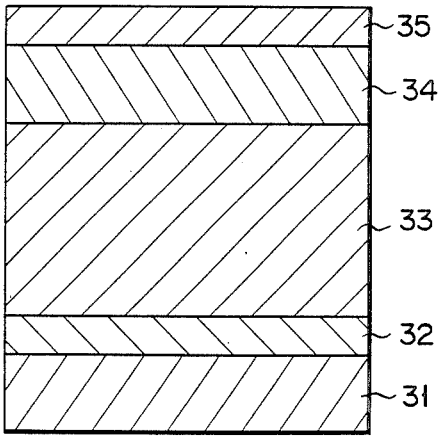

The electrophotographic photosensitive member is not limited to the aforementioned arrangement in which the substrate, barrier layer, photoconductive layer as a single photosensitive layer, and surface layer are successively stacked for lamination. For example, the photosensitive layer may be of a separate configuration including a charge-transport layer (CTL) on the substrate and a charge-generating layer (CGL) on the CTL. FIGS. 4 and 5 show sectional views showing photosensitive members of such a separate-function type. In FIG. 4, barrier layer 32 is formed on conductive substrate 31; CTL 33 on layer 32, and CGL 34 on CTL 33. In FIG. 5, surface layer 35 is further formed on CGL 34. At least a part of CGL 34 is formed of μc-Si, while CTL 33 is composed of a-Si.

Since CGL 34 is mainly formed of μc-Si, which exhibits high light absorptivity in the infrared area, the photosensitive member can enjoy high photosensitivity over a wide range of wavelengths covering both visible radiation and near-infrared radiation (e.g., centering around a wavelength of 790 nm equivalent to the oscillation wavelength of semiconductor laser). Thus, the photosensitive member can be used for both plain paper copiers (PPC) and laser printers. If CGL 34, mainly formed of μc-Si which is more or less of an n-type itself, is light-doped (to $10^{-7}$ to $10^{-3}$ percent by at. wt.) with an element included in group III or V of the periodic table, it is converted to an i-type (intrinsic) semiconductor, whose dark re-sistance is high, and whose signal-to-noise ratio and chargeability are improved. Also, CGL 34 preferably contains at least one element selected from carbon, oxygen, and nitrogen to a degree such that its photoconductivity is not lowered. Thus, it is further improved in electric charge holding capability.

CTL 33, which serves to deliver the charge carriers generated in CGL 34 to substrate 31 at a high rate, is formed of a-Si containing hydrogen. The dark resistance and hence, charge-holding capability of CTL 33 can be improved if it is light-doped with an element included in group III of the periodic table. To the same end, CTL 33 may be made to contain carbon, oxygen, or nitrogen to a degree such that the $\eta\mu\tau$-product of charges is not lowered. In consideration of the charge-running capability, the carbon, oxygen, or nitrogen content is preferably restricted to 20 atomic percent.

As in the embodiment shown in FIGS. 1 and 2, barrier layer 32 is formed of μc-Si.

The electrophotographic photosensitive member shown in FIG. 5, like the one shown in FIG. 2, is formed with surface layer 35.

Figure 6:
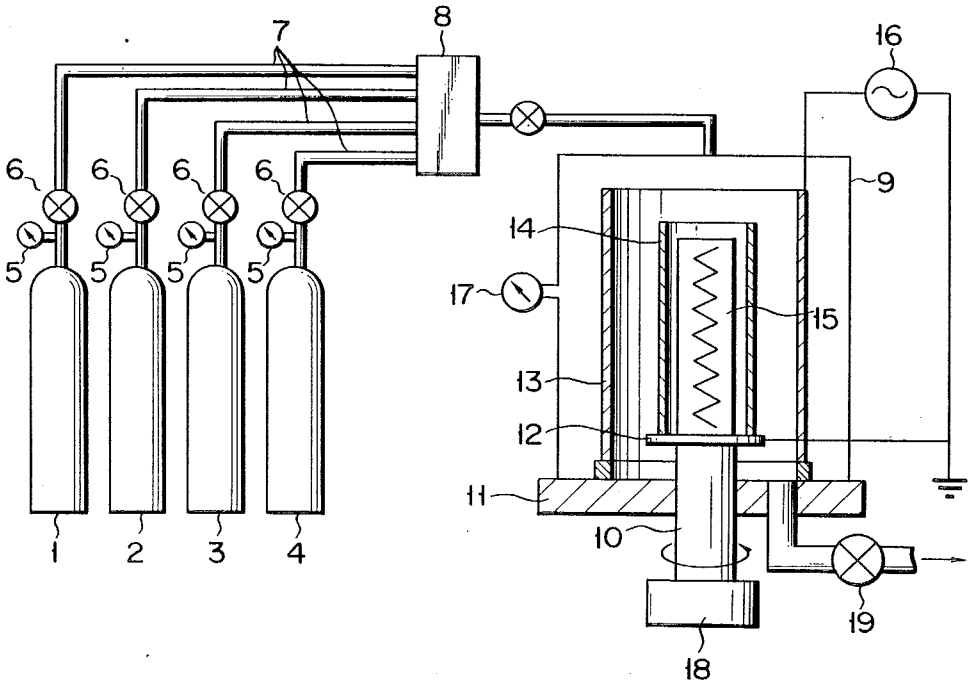
FIG. 6 shows an apparatus for manufacturing the photosensitive members of the invention.

FIG. 6 shows an apparatus for manufacturing the electrophotographic photosensitive member according to the present invention. Gas cylinders 1, 2, 3 and 4 contain material gases such as $SiH_4$, $B_2H_6$, $H_2$, and $CH_4$, respectively. The gases in cylinders 1 to 4 are fed into mixer 8 through pipes 7. Each cylinder is provided with pressure gage 5. The flow rate and mixture ratio of the material gases supplied to mixer 8 can be adjusted by controlling valve 6 while watching the pressure gage. The gas mixture resulting from mixing in mixer 8 is fed into reaction container 9. Rotating shaft 10 is attached to bottom portion 11 of container 9, so as to be rotatable around a vertical axis. Disk-shaped support 12 is fixed to the upper end of shaft 10, so that its surface extends at right angles to the shaft. Inside container 9, cylindrical electrode 13 is mounted on portion 11, so as to be coaxial with shaft 10. Drum base 14 of the photosensitive member is mounted on support 12, with its axis in alignment with that of shaft 10. Drum base heater 15 is located in the drum base. High-frequency power source 16 is connected between electrode 13 and base 14, whereby high-frequency current is supplied between the two. Shaft 10 is rotated by motor 18. The pressure inside reaction container 9 is monitored by pressure gage 17, and the container is coupled to a suitable exhaust means, such as a vacuum pump, through gate valve 19.

In manufacturing the photosensitive member by means of the apparatus constructed in this manner, drum base 14 is set in reaction container 9, and gate valve 19 is then opened to gas-purge the container to a pressure of 0.1 torr or less. Then, the necessary reaction gases from cylinders 1 to 4 are mixed at a predetermined mixture ratio and introduced into container 9. In this case, the flow rate of the gas mixture fed into container 9 is set so that the pressure inside the container ranges from 0.1 to 1 torr. Subsequently, motor 18 is started to rotate drum base 14, and the base is heated to a set temperature. At the same time, high-frequency power source 16 supplies high-frequency current between electrode 13 and base 14, thereby causing glow discharge between them. As a result, microcrystalline silicon (μc-Si) is deposited on drum base 14. The μc-Si layer can be made to contain elements included in $NH_3$, $NO_2$, $N_2$, $CH_4$, $C_2H_4$, and $O_2$ gases by using these gases as the material gases.

Thus, the electrophotographic photosensitive member according to the present invention, like the prior art one using a-Si, can be made by the use of a closed-type manufacturing apparatus, which is highly safe. Highly resistant to heat, moisture and wear, the photoconductive layer of the member can stand prolonged, repeated use with less deterioration, thus ensuring a long life. Moreover, there is no need of a sensitizing gas, such as $GeH_4$, for enhancing the sensitivity to long-wavelength light. Therefore, it is not necessary to provide any exhaust-gas-processing equipment. Thus, the efficiency of the industrial production process is very high.

Examples of the present invention will now be described.

EXAMPLE 1

While an aluminum drum was being heated to 300° C., $SiH_4$ gas was mixed with 0.01 to 3.0 percent $B_2H_6$ gas, 1 to 300 percent $H_2$-$CH_4$ gas mixture, and 1 to 1,500 percent $H_2$-He gas mixture, by volume or flow rate compared to the $SiH_4$ gas, and the resulting gas mixture was fed into the reaction container. High-frequency power of 150 W was applied to the gas mixture at a reaction pressure of 0.2 torr, for glow discharge, and barrier layer 21 was formed after 30 minutes of filming. Then, the photoconductive layer was formed, after 5 hours of filming, by applying high-frequency power of 300 W to a gas mixture which was prepared by mixing $SiH_4$ gas with 0.01 to 1 percent $B_2H_6$ gas and 0.5 to 2,000 percent $H_2$-He gas mixture by volume, at a pressure of 0.3 torr. Further, $CH_4$ gas and nitrogen gas, equivalent to or up to tens of times as much as the $SiH_4$ gas in total flow volume, were fed, and high-frequency power of 150 W was applied to them at a pressure of 0.3 torr, for 5 minutes, to form the surface layer. The overall film thickness was 180 μm. When a voltage of +5 kV was applied to the resultant photosensitive member, a potential of 250 V was obtained. Moreover, the photosensitive member provided a highly satisfactory image when it was set in a copying machine for imaging.

EXAMPLE 2

Barrier layer 22 and photoconductive layer 23 were formed by mixing the $SiH_4$ gas with 0.01 to 2.0 percent (volume ratio to the $SiH_4$ gas) $PH_3$ gas and 1 percent or less (volume ratio to the $SiH_4$ gas) $PH_3$ gas, respectively, instead of the $B_2H_6$ gas. Other conditions were the same as those of example 1. Also in example 2, the resultant photosensitive drum provided a satisfactory image when it was set in the copying machine for imaging.

EXAMPLE 3

While an aluminum drum was being heated to 300° C., $SiH_4$ gas was mixed with 0.01 to 3.0 percent $B_2H_6$ gas, 1 to 300 percent $N_2$-$CH_4$ gas mixture, and 10to 1,000 percent $H_2$-He gas mixture, by volume or flow rate compared to the $SiH_4$ gas, and the resulting gas mixture was fed into the reaction container. High-frequency power of 150 W was applied to the gas mixture, at a reaction pressure of 0.2 torr, for flow discharge, and barrier layer 21 was formed after 30 minutes of filming. Then, the photoconductive layer was formed after 5 hours of filming by applying high-frequency power of 300 W to a gas mixture which was prepared by mixing $SiH_4$ gas with 0.01 to 1 percent $B_2H_6$ gas and 10 tto 2,000 percent $H_2$-He gas mixture by volume at a pressure of 0.3 torr. Further, $CH_4$ gas and nitrogen gas, equivalent to or up to tens of times as much as the $SiH_4$ gas in total flow volume, were fed, and high-frequency power of 150 W was applied to them, at a pressure of 0.3 torr, for 5 minutes to form the surface layer. The overall film thickness 20 micrometers. When a current of +0.45 $\mu C/cm^2$ was applied to the resultant photosensitive member, a potential of 250 V was obtained. Moreover, the photosensitive member provided a highly satisfactory image when it was set in the copying machine for imaging.

EXAMPLE 4

Barrier layer 22 and photoconductive layer 23 were formed by mixing the $SiH_4$ gas with 0.01 to 2.0 percent (volume ratio to the $SiH_4$ gas) $PH_3$ gas, and 1 percent or less (volume ratio to the $SiH_4$ gas) $PH_3$ gas, respectively instead of the $B_2H_6$ gas. Other conditions were the same as those of example 3. Also in example 4, the resultant photosensitive drum provided a satisfactory image when it was set in the copying machine for imaging.

EXAMPLE 5

After an aluminum drum, for use as as a conductive substrate, was washed and dried, it was heated to 350° C. while the reaction container was being gas-purged by a diffusion pump. After about one hour of heating, the vacuum level in the container reached $3\times10^{-5}$ torr, whereupon the drum temperature was stabilized. Then, 300 SCCM of $SiH_4$ gas, $B_2H_6$ gas with a $5\times10^{-4}$ volume ratio to the $SiH_4$ gas, 60 SCCM of $CH_4$ gas, and 200 SCCM of argon gas were mixed and fed into the reaction container. High-frequency power of 150 W was applied to the gas mixture at 13.56 MHz for 2 minutes of glow discharge for filming. Thereafter, the flow rate of the $CH_4$ gas was lowered to 30 SCCM for 30 seconds of filming. Thus, barrier layer 21 was completed. The pressure inside the reaction container, at that time, was aproximately 0.8 torr, and the layer thickness obtained was 1.2 micrometers. Subsequently, all the gas flows were stopped, and the reaction container was gas-purged for 15 minutes. Thereafter, the flow rates of the $SiH_4$ gas and hydrogen gas were set to 600 SCCM and 500 SCCM, respectively, and the ratio of flow rate between $B_2H_6$and $SiH_4$ was adjusted to $8\times10^{-8}$. Then, high-frequency power of 350 W was applied at a reaction pressure of 1.5 torr, to form the photoconductive layer, with a thickness of 35 micrometers. Then, all the gas flows were stopped, and the container was gas-purged for 15 minutes. Thereafter, 100 SCCM of $SiH_4$ gas and 400 SCCM of $CH_4$ gas were fed, and high-frequency power of 200 W was applied at a reaction pressure of 0.7 torr, to form a surface layer of 1.5 μm thickness. A laser printer, mounted with a semiconductor laser of 790-nm oscillation wavelength, was used to form an image on the photosensitive member filmed in this manner. The resultant image was a highly satisfactory one, and the photosensitivity was as high as 10 $erg/cm^2$.

EXAMPLE 6

This example differs from example 5 only in that nitrogen gas was used in place of the $CH_4$ gas. The laser printer was used to form an image on the photosensitive member filmed in this manner. Also in this case, the resultant image was a satisfactory one, with high resolution, and the photosensitivity to 790-nm-wave radiation was as high as 9 $erg/cm^2$.

EXAMPLE 7

After an aluminum drum, for use as as a conductive substrate, was washed and dried, it was heated to 350° C. while the reaction container was being gas-purged by a diffusion pump. After about one hour of heating, the vacuum level in the container reached $3\times10^{-5}$ torr, whereupon the drum temperature was stabilized. Then, 300 SCCM of $SiH_4$ gas, $B_2H_6$ gas with a $5\times10^{-4}$ volume ratio to the $SiH_4$ gas, 60 SCCM of $CH_4$ gas, and 100 SCCM of hydrogen gas were mixed and fed into the reaction container. Highfrequency power of 200 W was applied to the gas mixture at 13.56 MHz for glow discharge, to form barrier layer 32. The pressure inside the reaction container, at that time, was approximately 0.8 torr, and the layer thickness obtained was 1.2 μm. Subsequently, all the gas flows were stopped, and the reaction container was gas-purged for 15 minutes. Thereafter, the flow rates of the $SiH_4$ gas and argon gas were set to 600 SCCM and 500 SCCM, respectively, and the ratio of $B_2H_6$ flow rate to $SiH_4$ was adjusted to $8\times10^{-8}$. Then, high-frequency power of 350 W was applied at a reaction pressure of 1.5 torr for glow discharge, to form CTL 33, with a thickness of 25 micrometers. Subsequently, the high-frequency power was reduced to zero, and the argon gas flow was stopped. Instead, the hydrogen gas, along with other gases, was fed at a flow rate of 200 SCCM for 5 minutes. After the gas flow stabilized, high-frequency power of 400 W was applied at a pressure of 1.2 torr, to form CGL 34, with a thickness of 4.0 micrometers. Then, all the gas flows were stopped, and the container was gas-purged for 15 minutes. Thereafter, 100 SCCM of $SiH_4$ gas and 400 SCCM of nitrogen gas were fed, and high-frequency power of 200 W was applied, at a reaction pressure of 0.7 torr, to form surface layer 35 of 2.0-μm thickness. The laser printer, mounted with the semiconductor laser of 790-nanometer oscillation wavelength, was used to form an image on the photosensitive member filmed in this manner. The resultant image was a distinct one, high in resolution, and free from fog and unevenness in density. After charging was repeated 1,000 times at room temperature, the surface potential and white ground potential with 50 erg/cm$^2$ exposure, whose initial values were 550 V and 30 V, respectively, were only reduced to 500 V and 27 V, respectively. Moreover, the half-life exposure was as high as 10 erg/cm$^2$.

EXAMPLE 8

After an aluminum drum, for use as a conductive substrate, was washed and dried, it was heated to 350° C. while the reaction container was being gas-purged by a diffusion pump. After about one hour of heating, the vaccum level in the container reached $3\times10^{-5}$ torr, whereupon the drum temperature was stabilized. Then, 300 SCCM of $SiH_4$ gas, $B_2H_6$ gas with a $5\times10^{-4}$ volume ratio to the $SiH_4$ gas, 80 SCCM of $CH_4$ gas, and 200 SCCM of hydrogen gas were mixed and fed into the reaction container. Highfrequency power of 200 W was applied to the gas mixture at 13.56 MHz for glow discharge, to form barrier layer 32. The pressure inside the reaction container, at that time, was approximately 0.8 torr, and the layer thickness obtained was 0.5 μm. Subsequently, all the gas flows were stopped, and the reaction container was gas-purged for 15 minutes. Thereafter, the flow rates of the $SiH_4$ gas, argon gas, and $CH_4$ were set to 600, 500 and 100 SCCM, respectively, and the ratio of flow rate between $B_2H_6$ and $SiH_4$ was adjusted to $5\times10^{-8}$. Then, high-frequency power of 450 W was applied at a reaction pressure of 1.5 torr, to form CTL 33, with a thickness of 32 μm. Subsequently, the highfrequency power was reduced to zero, and the argon gas flow was stopped. Instead, the flow rate of the hydrogen gas was adjusted to 200 SCCM, and fed together with the other gases for 5 minutes. After the gas flow was stabilized, high-frequency power of 400 W was applied at a pressure of 1.2 torr, to form CGL 34, with a thickness of 4.0 micrometers. Then, all the gas flows were stopped, and the container was gas-purged. Thereafter, 100 SCCM of $SiH_4$ gas and 400 SCCM of nitrogen gas were fed, and high-frequency power of 300 W was applied at a reaction pressure of 0.7 torr, to form surface layer 35 of 1.5-μm thickness. The laser printer, mounted with the semiconductor laser of 790-nm oscillation wavelength, was used to form an image on the photosensitive member filmed in this manner. The resultant image was a distinct one, high in resolution, and free from fog and unevenness in density. After charging was repeated 1,000 times at room temperature, the surface potential and white ground potential with 50 erg/cm$^2$ exposure, whose initial values were 650 V and 25 V, respectively, were only reduced to 620 V and 24 V, respectively. Moreover, the halflife exposure to 790-nm-wave radiation was as high as 10 erg/cm$^2$.

What is claimed is:

1. An electrophotographic photosensitive member comprising:

a conductive substrate;

a barrier layer provided on the conductive substrate, at least part of said barrier layer being formed of microcrystalline silicon containing hydrogen, an element included in group III or V of the periodic table, and at least one element selected from carbon, oxygen, and nitrogen; and a photosensitive layer provided on the barrier layer, at least part of said photosensitive layer being formed of microcrystalline silicon.

2. The electrophotographic photosensitive member according to claim 1, wherein said photosensitive layer is a photoconductive layer.

3. The electrophotographic photosensitive member according to claim 2, wherein said photoconductive layer contains $10^{-7}$ to $10^{-3}$ atomic percent of an element included in group III of the periodic table.

4. The electrophotographic photosensitive member according to claim 1, wherein said photoconductive layer includes microcrystalline silicon regions and amorphous silicon regions, distributed mixedly.

5. The electrophotographic photosensitive member according to claim 1, wherein said photoconductive layer includes a microcrystalline silicon layer and an amorphous silicon layer, stacked for lamination.

6. The electrophotographic photosensitive member according to claim 1, wherein the hydrogen content of said barrier layer ranges from 0.1 to 30 atomic percent.

7. The electrophotographic photosensitive member according to claim 1, wherein the group-III or -V element content of said barrier layer ranges from $10^{-3}$ to 10 atomic percent.

8. The electrophotographic photosensitive member according to claim 1, wherein the content of each of the at least one element selected from carbon, oxygen, and nitrogen of said barrier layer ranges from 0.1 to 20 atomic percent.

9. The electrophotographic photosensitive member according to claim 2, wherein the thickness of said photoconductive layer ranges from 3 to 80 μm.

10. The electrophotographic photosensitive member according to claim 1, wherein the thickness of said barrier layer ranges from 0.01 to 10 μm.

11. The electrophotographic photosensitive member according to claim 1, further comprising a surface layer of amorphous silicon formed on said photoconductive layer.

12. The electrophotographic photosensitive member according to claim 11, wherein said surface layer contains at least one element selected from carbon, oxygen, and nitrogen.

13. The electrophotographic photosensitive member according to claim 12, wherein the content of the at least one element selected from carbon, oxygen, and nitrogen, of said surface layer, ranges from 10 to 50 percent by atomic weight.

14. The electrophotographic photosensitive member according to claim 2, wherein that region of said photoconductive layer on the surface side of the photosensitive member contains at least one element selected from carbon, oxygen, and nitrogen.

15. The electrophotographic photosensitive member according to claim 14, wherein the element or elements contained in said surface-side region of the photoconductive layer are reduced in density with distance from the surface of the photosensitive member.

16. The electrophotographic photosensitive member according to claim 14, wherein the at least one element selected from carbon, oxygen, and nitrogen, contained in said barrier layer is reduced in density with distance from the conductive substrate.

17. The electrophotographic photosensitive member according to claim 1, wherein said photosensitive layer includes a charge-transport layer formed on the conductive substrate, and a charge-generating layer provided on the charge-transport layer, at least part of said charge-generating layer being formed of microcrystalline silicon.

18. The electrophotographic photosensitive member according to claim 17, wherein the thickness of said charge-generating layer is 5 μm or less, and the thickness of said charge-transport layer ranges from 3 to 80 μm.

* * * * *